US007565931B2

(12) United States Patent
Saucier

(10) Patent No.: US 7,565,931 B2
(45) Date of Patent: Jul. 28, 2009

(54) DUAL BORE WELL JUMPER

(75) Inventor: Brian J. Saucier, Magnolia, TX (US)

(73) Assignee: Energy Equipment Corporation, Houston, TX (US)

( * ) Notice: Subject to any disclaimer, the term of this patent is extended or adjusted under 35 U.S.C. 154(b) by 458 days.

(21) Appl. No.: 11/284,976

(22) Filed: Nov. 22, 2005

(65) Prior Publication Data

US 2006/0118308 A1 Jun. 8, 2006

Related U.S. Application Data

(60) Provisional application No. 60/630,009, filed on Nov. 22, 2004.

(51) Int. Cl.
*E21B 29/12* (2006.01)

(52) U.S. Cl. ..... 166/344; 166/345; 166/368; 166/89.2; 166/88.4

(58) Field of Classification Search ..... 166/344, 166/345, 347, 366, 88.4, 89.1, 89.2; 285/123.1; 405/169, 170
See application file for complete search history.

(56) References Cited

U.S. PATENT DOCUMENTS 3,353,595 A * 11/1967 Gruller et al. ..... 166/341
3,485,516 A * 12/1969 Kell et al. ..... 285/14
3,766,357 A * 10/1973 Koester, Jr. ..... 392/478
3,770,052 A * 11/1973 Childers ..... 166/351
3,825,045 A * 7/1974 Bloomquist ..... 141/198
3,834,460 A 9/1974 Brun et al.
3,953,982 A * 5/1976 Pennock ..... 405/168.1
4,039,208 A * 8/1977 Pernet et al. ..... 285/3
4,099,542 A * 7/1978 Gibbons ..... 137/615
4,625,806 A * 12/1986 Silcox ..... 166/358
4,848,474 A 7/1989 Parizot et al.
4,848,475 A 7/1989 Dean et al.
5,040,607 A * 8/1991 Cordeiro et al. ..... 166/366
5,159,982 A 11/1992 Hynes
5,195,589 A * 3/1993 Mota et al. ..... 166/341
5,289,882 A * 3/1994 Moore ..... 166/379
5,458,440 A * 10/1995 Van Helvoirt ..... 405/169
6,022,421 A * 2/2000 Bath et al. ..... 134/8
6,059,039 A * 5/2000 Bednar et al. ..... 166/344
6,082,460 A 7/2000 June
6,213,215 B1 4/2001 Breivik et al.
6,253,855 B1 * 7/2001 Johal et al. ..... 166/367
6,349,976 B1 * 2/2002 Taylor, Jr. ..... 285/123.1
6,357,529 B1 * 3/2002 Kent et al. ..... 166/344

(Continued)

*Primary Examiner*—Thomas A Beach
(74) *Attorney, Agent, or Firm*—Locke Lord Bissell & Liddell LLP

(57) ABSTRACT

A dual bore well jumper establishing fluid communication between a subsea well and a subsea flowline. The dual bore well jumper comprises a first pipe comprising a first pipe bore and a second pipe comprising a second pipe bore, the second pipe being located within the first pipe bore or side-by side with the first pipe. The dual bore well jumper further comprises termination couplings at each for establishing fluid communication with either the subsea flowline or the subsea well. The first and second pipe bores isolate fluid flow in the first pipe bore from fluid flow in the second pipe bore. The dual bore well jumper may optionally further comprise junction assemblies allowing a change in fluid flow direction. The dual bore well jumper may further optionally comprise a bore access module attached to a junction assembly for selective fluid communication with the first and second bores.

25 Claims, 9 Drawing Sheets

U.S. PATENT DOCUMENTS

| | | | | |
|---|---|---|---|---|
| 6,494,266 | B2 | 12/2002 | Bartlett et al. | |
| 6,817,418 | B2 * | 11/2004 | Gatherar et al. | 166/368 |
| 6,880,640 | B2 * | 4/2005 | Barratt et al. | 166/346 |
| 7,100,694 | B2 * | 9/2006 | Legras et al. | 166/350 |
| 7,108,069 | B2 | 9/2006 | Killie et al. | |
| 7,219,740 | B2 * | 5/2007 | Saucier | 166/366 |
| 7,226,089 | B2 * | 6/2007 | Wilkinson, III | 285/123.15 |
| 7,296,629 | B2 * | 11/2007 | Bartlett | 166/348 |
| 7,422,066 | B2 * | 9/2008 | Rodrigues et al. | 166/341 |
| 2003/0180096 | A1 | 9/2003 | Appleford et al. | |
| 2005/0070150 | A1 * | 3/2005 | Williams | 439/374 |
| 2006/0231266 | A1 * | 10/2006 | Rodrigues et al. | 166/365 |
| 2007/0227740 | A1 * | 10/2007 | Fontenette et al. | 166/344 |
| 2007/0235195 | A1 * | 10/2007 | Lawson | 166/352 |
| 2008/0056826 | A1 * | 3/2008 | Luppi | 405/171 |
| 2008/0093081 | A1 * | 4/2008 | Stoisits et al. | 166/366 |

* cited by examiner

DUAL BORE WELL JUMPER

CROSS-REFERENCE TO RELATED APPLICATIONS

This application claims the benefit of 35 U.S.C. 119(e) from U.S. Provisional Application Ser. No. 60/630,009, filed Nov. 22, 2004 and entitled "Well Production Hub", hereby incorporated herein by reference for all purposes.

STATEMENT REGARDING FEDERALLY SPONSORED RESEARCH OR DEVELOPMENT

Not Applicable.

BACKGROUND

Subsea oil/gas fields may have a plurality of wells linked to a host facility that receives the oil/gas via flowlines. Such a field may have a subsea well field architecture that employs either single or dual flowlines designed in a looped arrangement with in-line pipe line end termination ("PLET") units positioned at selective locations for well access. The linkage between wells creates a need for PLETs to be deployed within prescribed target box areas to allow for well jumper connections to the flowline. These typically non-recoverable PLETS support flowline connectors that allow fluid flow access between the wells and the flowline. Well jumpers connect the production trees on the wells to the flowline through the flowline connectors. For well testing or intervention operations, unless a well can be accessed through the tree, selected flowlines may be depressurized and a well isolated to flow fluids to or from a well.

The subsea oil/gas field may also include processing systems or production manifolds between the wells and the host facility. Using a manifold system, each well has a well jumper attached to a manifold, consisting of either single or dual flowline headers accepting production from a single well jumper distributed into single or dual flowlines. The manifold provides flowline access valves to selectively isolate wells. In this manner, fluids may flow to or from an isolated well without having to depressurize both of the flowlines. Fluid flow for testing, intervention, or other operations may be done through direct connection with each well tree. Fluids may also flow to or from an isolated well from the host facility through one or both of the flowlines. If only one of the flowlines is depressurized, the dual well jumpers allow for fluid flow from the non-isolated wells to the non-depressurized flowline.

An alternative subsea well field architecture employs the use of well production hubs connecting wells to one or more flowlines as illustrated in FIG. 1. Fluid communication between the wells and the well production hub is accomplished though jumpers connected to each well. The well production hub allows the attachment of a utility module or flowline intervention/access tool and is capable of isolating flow between the well production hub and a well for conducting operational activities on the isolated well or a flowline. The well production hub subsea architecture is described in U.S. patent application titled "Well Production Hub" filed concurrently herewith and incorporated by reference for all purposes.

Independent of the well field architecture, operational activities are typically performed on well throughout the life of the well. For example, well operations may include well/flowline circulation, intervention activities, bull heading/well kill, or pigging. These and other well operations may be performed by connecting tools directly at the subsea wellhead/subsea tree location and/or at the host production facility. The direct access into the wellhead/subsea tree typically requires intervention vessels, special intervention tooling, shut-in of production and depressurization of at least selected flowline sections, multiple rig mooring, and additional anchor handling due to the satellite offsets between the wells.

BRIEF DESCRIPTION OF THE DRAWINGS

For a more detailed description of the embodiments, reference will now be made to the following accompanying drawings.

DETAILED DESCRIPTION OF THE EMBODIMENTS

Figure 1:
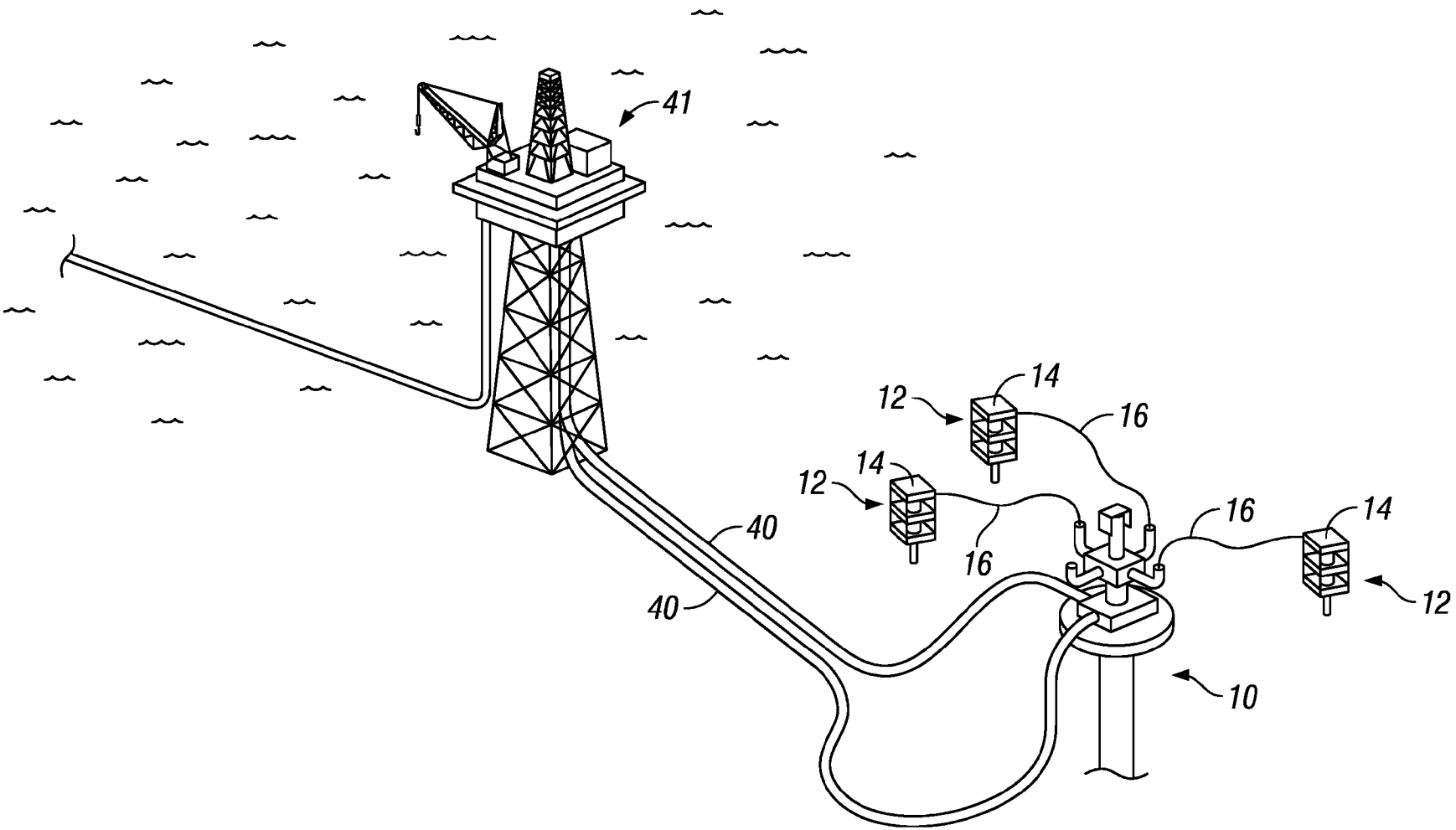
FIG. 1 is an perspective view of a subsea well field architecture with a well production hub.

In the drawings and description that follows, like parts are marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness. The present invention is susceptible to embodiments of different forms. Specific embodiments are described in detail and are shown in the drawings, with the understanding that the present disclosure is to be considered an exemplification of the principles of the invention, and is not intended to limit the invention to that illustrated and described herein. It is to be fully recognized that the different teachings of the embodiments discussed below may be employed separately or in any suitable combination to produce desired results. Any use of any form of the terms "connect", "engage", "couple", "attach", or any other term describing an interaction between elements is not meant to limit the interaction to direct interaction between the elements and may also include indirect interaction between the elements described. The various characteristics mentioned above, as well as other features and characteristics described in more detail below, will be readily apparent to those skilled in the art upon reading the following detailed description of the embodiments, and by referring to the accompanying drawings.

FIG. 1 illustrates a well production hub 10 used in a well field architecture to fluidly communicate with at least one oil and/or gas well 12. Although the subsea well field architecture described for the purposes of this application employs a well production hub, other types of well field architecture systems may also be used. Once each well 12 is drilled and cased, a production tubing is installed within the casing thus creating an annulus between the production tubing and the casing and creating two well flowbores 12*a* and 12*b*. A production tree 14 is then installed on each wellhead to control fluid flow into and out of each well 12 either through the production tubing or through the production tubing annulus. Attached to each well tree 14 is a dual bore well jumper 16 that connects each well 12 to the well production hub 10. Production fluids may then flow from a well 12 to the well production hub 10 and then through at least one flowline 40 to a host facility 41. It should also be appreciated that there may be more than one well production hub 10 connected to each other to connect multiple well fields before fluid flow back to a host facility 41.

Figure 2:
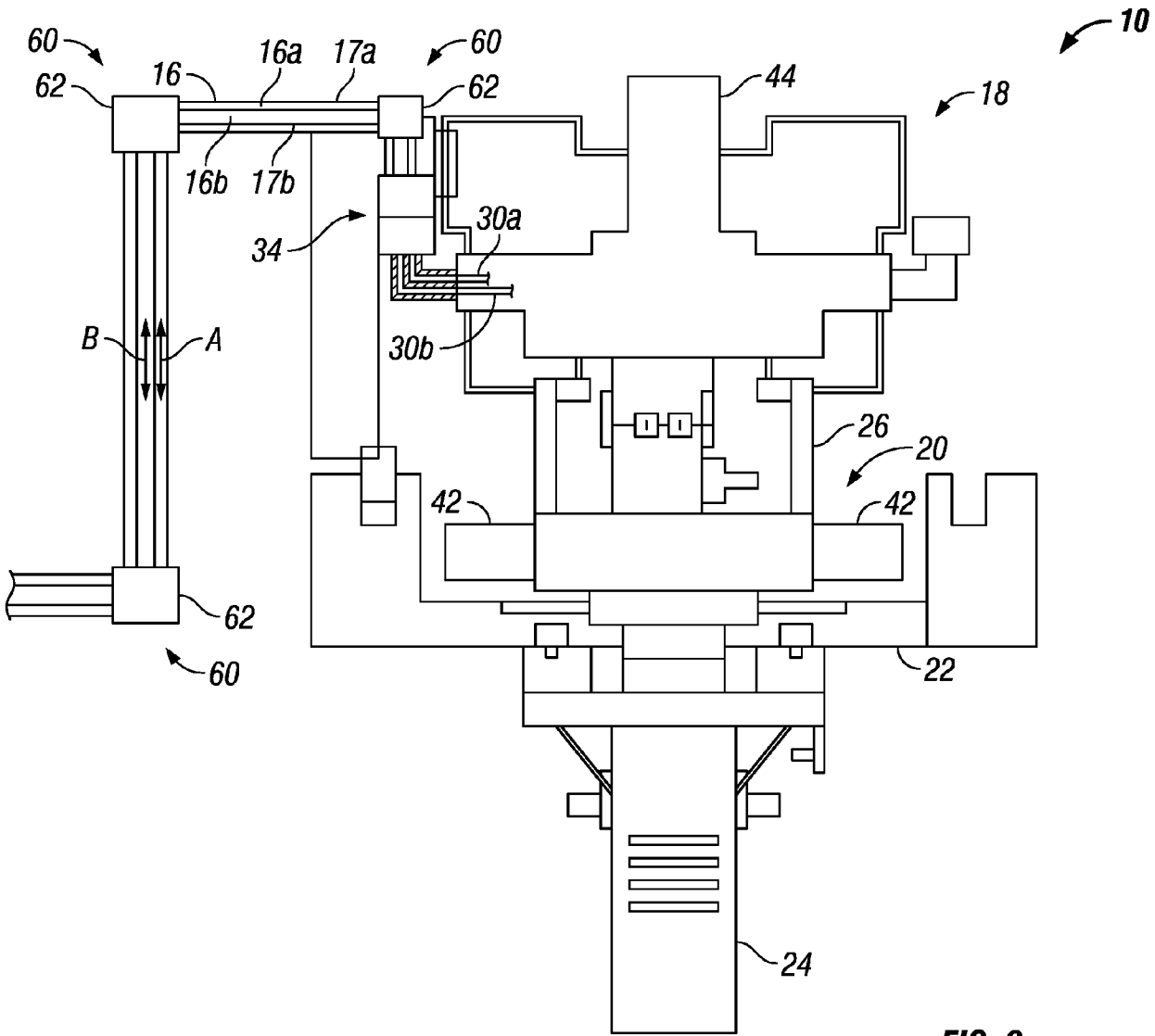
FIG. 2 is a schematic side elevation view of a pipe-in-pipe dual bore well jumper connected to the well production hub of FIG. 1.
Figure 6:
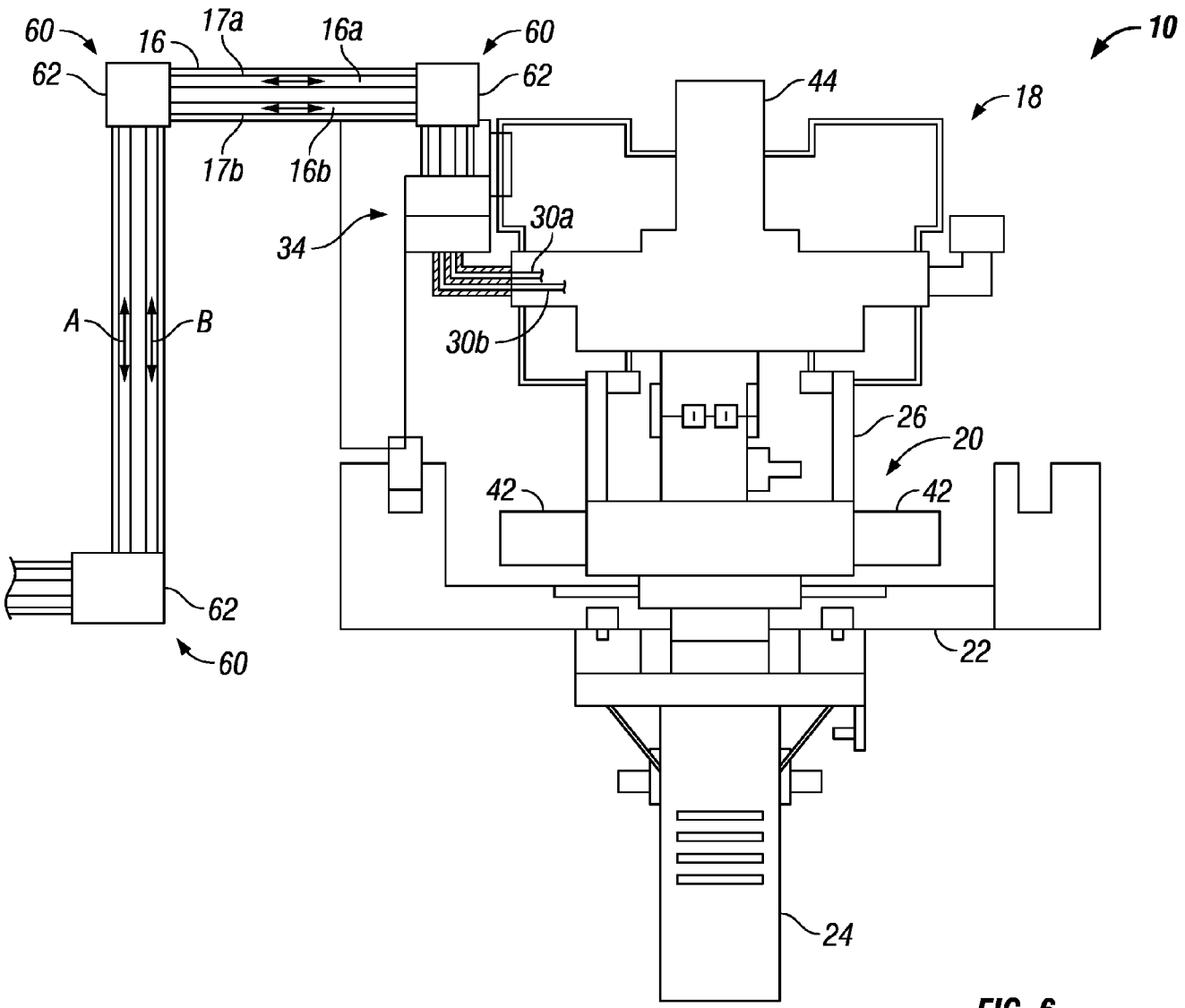
FIG. 6 is a schematic side elevation view of a side-by-side dual bore well jumper connected to the well production hub of FIG. 1.

The well production hub 10, as illustrated in FIGS. 2 and 6, comprises a production header module 18 that accepts connection from at least one well 12 through a dual bore well jumper 16. The well production hub 10 further comprises a flowline header module 20 that connects to the production header module 18. The well production hub 10 may be installed on a modular interface platform 22 connected to a monopile support 24.

As illustrated in FIG. 2, the production header module 18 may further comprise at least one well jumper termination coupling 34 for establishing fluid flow with a well 12 through the dual bore well jumper 16. The dual bore well jumper 16 comprises a first pipe 17*a* comprising a first pipe bore 16*a*. The dual bore well jumper also comprises a second pipe 17*b* comprising a second pipe bore 16*b*, the second pipe being located within the first pipe bore 16*a*. The second pipe bore 16*b* is illustrated as being concentric to the first pipe bore 16*a*. However, the second pipe bore 16*b* may also be offset from the center of the first pipe bore 16*a*. Single bore well jumpers allow fluid flow in one direction at a time. As illustrated in FIG. 2, however, the dual bore well jumper 16 allows fluid flow through the well jumper 16 in different directions at the same time with the fluid flow in one direction being isolated from the fluid flow in the other direction, as indicated by the direction arrows "A" and "B". The dual bore well jumper 16 also allows the flow of different fluids in the same direction, the fluid in one bore being isolated from the fluid flow in the second bore. The dual bore well jumper 16 may optionally have the first pipe 17*a* rigid enough to allow single point contact with rigging without catastrophic bending of the dual bore well jumper 16.

Figure 3:
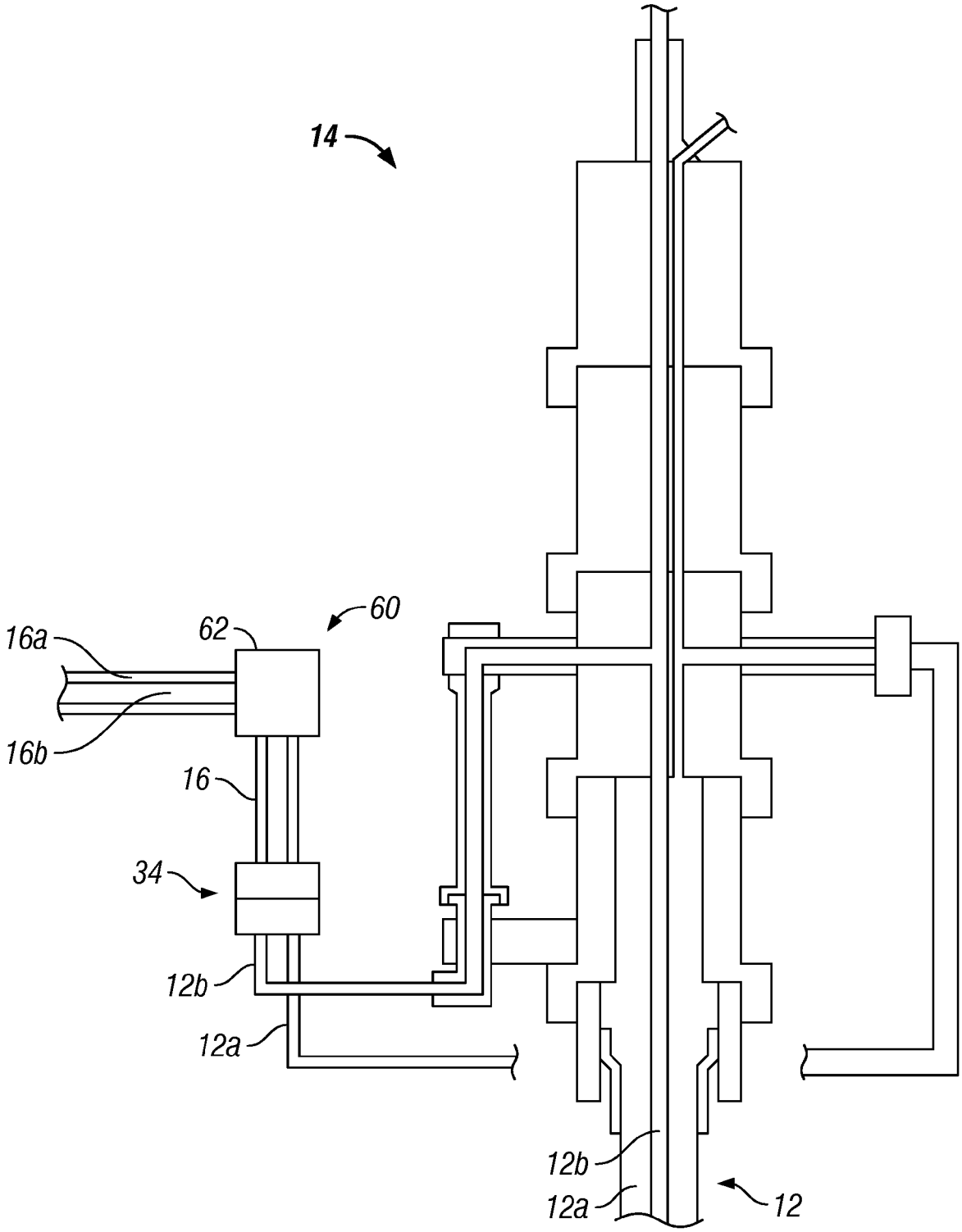
FIG. 3 is a schematic side elevation view of the dual bore well jumper of FIG. 2 connected a well tree.
Figure 5B:
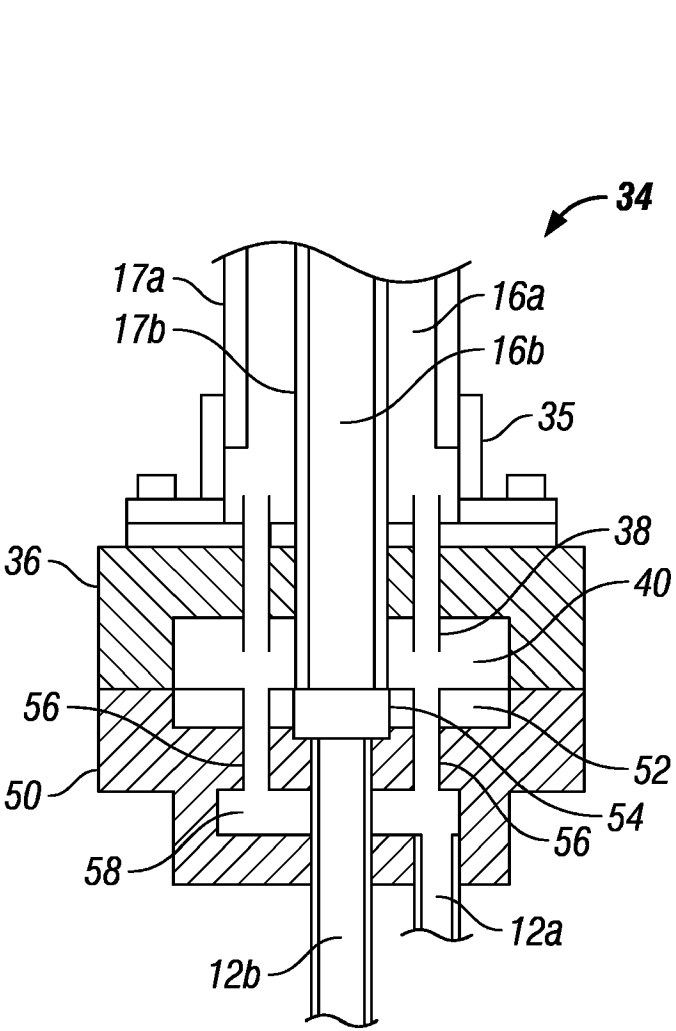
FIG. 5B is a schematic side elevation view of the connected end termination assembly of the dual bore well jumper of FIG. 2.
Figure 5A:
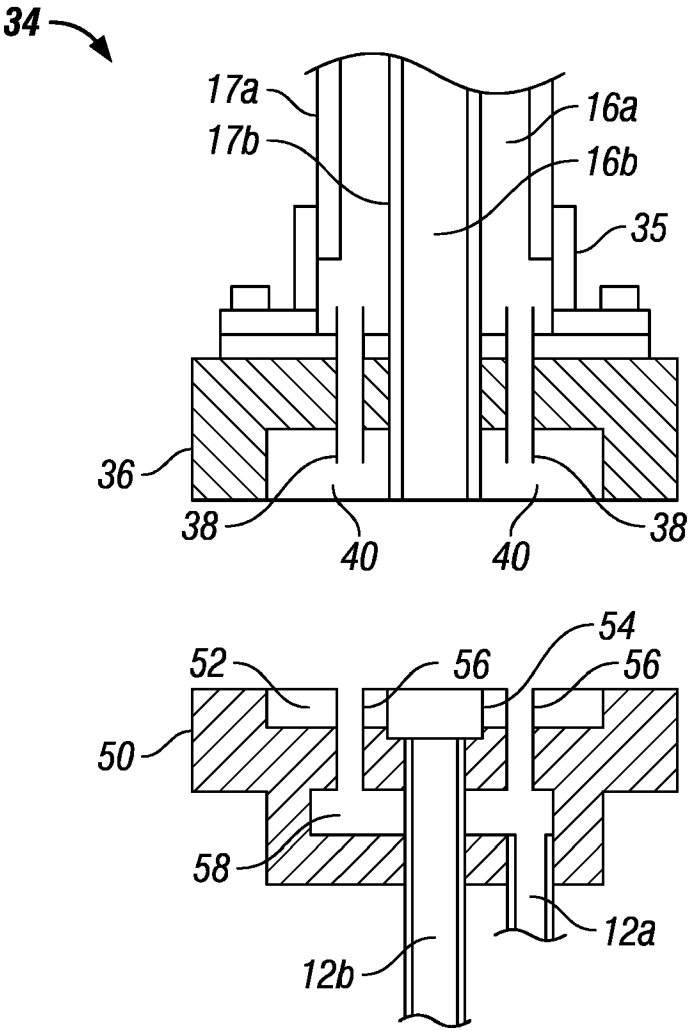
FIG. 5A is a schematic side elevation view of the unconnected end termination assembly of the dual bore well jumper of FIG. 2.

The dual bore jumper 16 illustrated in FIG. 2 comprises termination couplings 34 at each end coupling the jumper 16 with the well 12 or, as illustrated by the drawings, the well production hub 10. The termination couplings 34 may be any suitable type of coupling to provide a sealed engagement and separation of the flow in the second pipe bore 16*b* from inside the flow of the first pipe bore 16*a*. For example, as illustrated in FIGS. 5A and 5B, the dual bore well jumper 16 may comprise a crossover termination coupling 34. The crossover termination coupling 34 comprises a male base plate 36 sealingly engaged with the dual bore jumper 16 by attachment of the first pipe 17*a* into a pipe adapter 35. First pipe bore conduits 38 fluidly connect the first pipe bore 16*a* with an annulus area 40. The second pipe 17*b* extends through and past the base plate 36. The item being connected to, whether it be a well tree or a production hub, comprises a corresponding female base plate 50 that sealingly engages with the male base plate 36 to form a combined annular area that includes the male base plate annular area 40 and the female base plate annular area 52. Upon connection, the second, or inner, pipe 17*b* stab connects with an inner bore connector 54 that allows the flow in the second pipe bore 16*b* to communicate with a second pipe flow conduit 12*b*, which, for example, may be the production tubing as illustrated in FIG. 3. The flow in the first pipe bore 16*a* communicates with the first pipe bore conduits 38 and also with the corresponding female base plate first pipe bore conduits 56 through the combined annular areas 40 and 52. The female base plate first pipe bore conduits 56 also communicate with a cavity 58 separate from the second pipe flow conduit 12*b*. Fluid in the cavity 58 also communicates with a first pipe flow conduit 12*a*, which, for example, may be the production annulus as illustrated in FIG. 3. Thus, the termination coupling 34 allows the dual bore jumper 16 to attach the well 12 or, as illustrated by the drawings, the well production hub 10. The termination coupling 34 may be used to attach to a coupler on any corresponding unit however, and is not limited to well trees or well production hubs.

Figure 4:
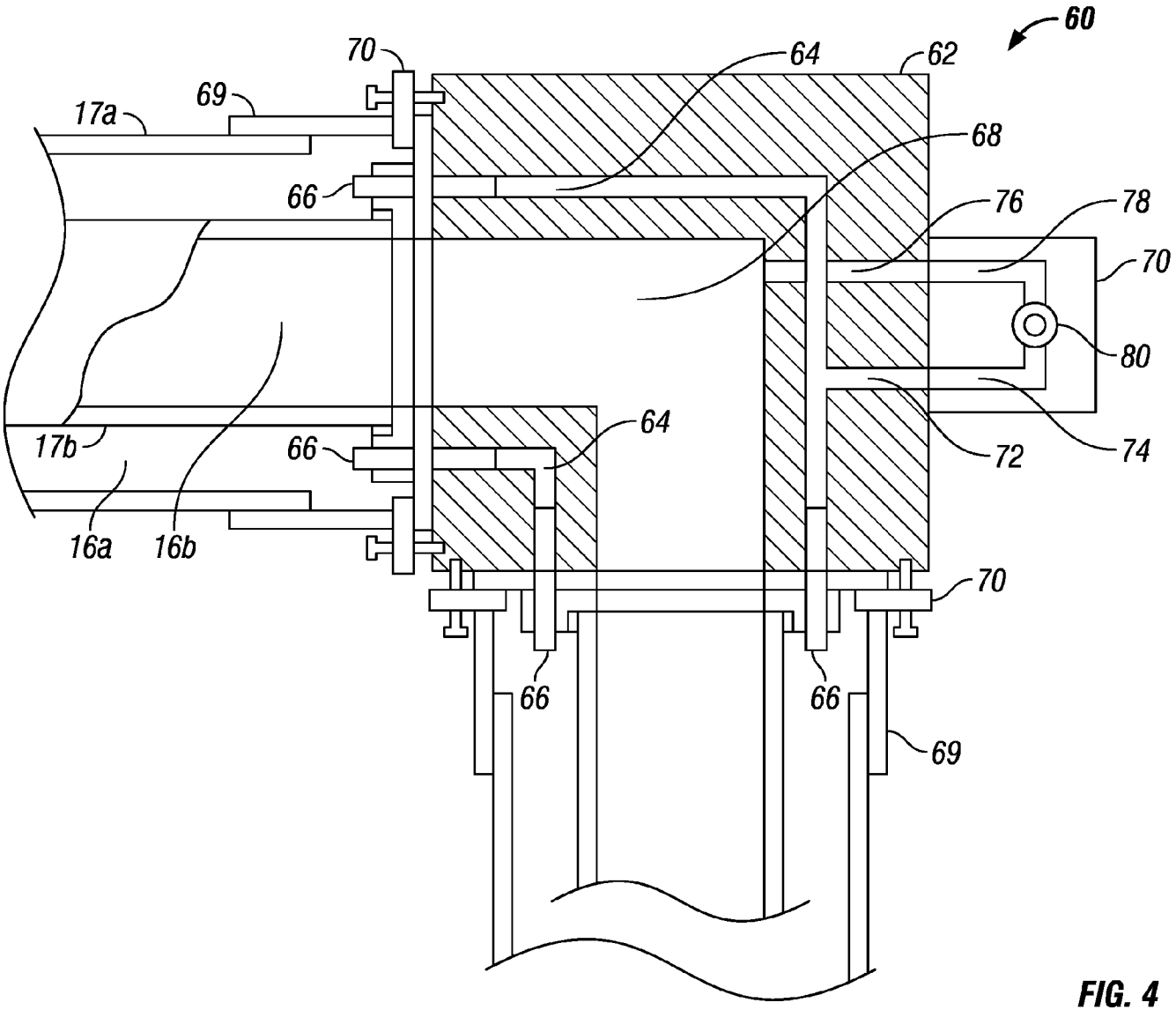
FIG. 4 is a schematic side elevation view of a junction assembly of the dual bore well jumper of FIG. 2.

As illustrated in FIG. 4, the dual bore well jumper 16 may optionally further comprise a junction assembly 60 fluidly connecting more than one set of said first and second pipes 17*a* and 17*b*. The junction assembly 60 comprises a junction assembly block 62. The sets of first and second pipes 17*a*, 17*b* attach to the junction assembly block 62 using a pipe adapter assembly that comprises a pipe adapter 69 and a mounting bracket 70. The engagement of the first pipe 17*a* with the first pipe adapter 69 is adjustable such that the position of the well jumper 16 relative to the junction assembly 60 may be adjusted without losing the sealing connection. For example, the first pipe 17*a* may thread into the pipe adapter 69 such that relative movement is allowed without losing a sealed connection.

Within the junction assembly block 62 is at least one first junction bore 64 configured to allow fluid communication between the first pipe bores 16*a* attached to the junction assembly block 62. Flow between the first pipe bores 16*a* and the first junction bore 64 communicates through first pipe bore conduits 66 that extend from the junction assembly block 62 and into the first pipe bores 16*a*. Also within the junction assembly block 62 is a second junction bore 68 configured to allow fluid communication between the second pipe bores 16*b*. The first junction bore 64 is configured to isolate fluid flow from the second junction bore 64 as fluid flows though the junction assembly 60. The junction assembly 60 may be configured such as to allow any suitable angle between the flow axis of the sets of first and second pipes 17*a*, 17*b*. For example, as illustrated in FIG. 4, the sets of first and second pipes 17*a*, 17*b* are at approximately 90 degrees to each other. Other angles may also be maintained, including no changed in direction at all if the junction assembly 60 is merely placed in-line with a well jumper 16. It should be appreciated that more than one set of first and second pipes 17*a*, 17*b* may also be attached to a junction assembly 60.

The junction assembly 60 may further optionally comprise a bore access module 70 attached to the junction assembly block 62. The bore access module 70 may attach to the junction assembly by any suitable connection, for example, a standard API flange connection. When attached to the junction assembly block 62, the bore access module 70 may be placed in selective fluid communication with the first and second junction bores 64 and 68. The bore access module 70 communicates with the first junction bore 64 through a first access bore 72 located in the junction assembly block 62 and a first module bore 74 located in the bore access module 70. The bore access module 70 communicates with the second junction bore 68 through a second access bore 76 located in the junction assembly block 62 and a second module bore 78 located in the bore access module 70. The bore access module 70 may perform any multitude of functions. For example the bore access module 70 may comprise a valve located in a utility bore 80 configured to allow fluid communication between the first junction bore 64 and the second junction bore 68. In this manner, the normally isolated fluids in the first and second pipe bores 16*a,b* may be commingled if desired. Alternatively, the bore access module may comprise a sensor located in the utility bore 80 for determining a characteristic of a fluid, the sensor being in selective fluid communication with the first and second junction bores 64 and 68. Also alternatively, the bore access module 60 may allow fluid injection into one or both of the first and second junction bores 64 and 68 through the utility bore 80.

The first and second pipe bores 16*a,b* provide independent pressure and fluid conduits to each other. With at least one well 12 connected to the well production hub 10, the initial stages of production may be performed, such as clean up, flow back, well testing, or other pre-production operations. The production header module 18 further comprises a utility interface 44 to which a utility module may be connected. The utility module may be any suitable utility module. For example, the utility module may be a lower marine rise package ("LMRP") that extends to the MODU or other vessel. With the LMRP connected to the well production hub 10, fluid flow through the dual bore jumper 16 may flow through the well production hub 10 and into the LMRP. The fluids initially produced by a well 12 may then be collected and tested to perform well clean up and well testing operations. Once a well 12 has been tested, flow from the dual bore well jumper 16 may then be directed into the flowline header module 20 and out through the flowline 40 to the host facility 41. The well production hub 10 may also be configured and set to isolate and test one well 12 at a time if more than one well 12 is connected to the well production hub 10. The well clean up and test fluids may also be directed to a host facility 41 through the flowline 40 instead of through the LMRP.

The dual bore well jumper 16 thus allows intervention procedures to be performed by allowing access to the production tubing in the well 12 as well as the production tubing annulus simultaneously. Thus, fluids may be circulated from a well production hub 10 and into the production tubing 12*b* through the second pipe bore 16*b* as illustrated by the connection in FIG. 3. From the production tubing, the fluids may circulate back up the production tubing annulus 12*a* and back to the well production hub 10 though the first pipe bore 16*a*. Additionally, fluids from the production tubing 12*b* may flow through the second pipe bore 16*b* to the well production hub 10 at the same time as fluid from the production tubing annulus 12*a* flows through the first pipe bore 16*a* to the well production hub 10. This allows for simultaneous annulus pressure management while production fluids are still being produced from the well 12. Another example is if a packer sealing the production tubing annulus 12*a* begins to leak, a gas cap may be injected through the first pipe bore 16*a* to control the pressure in the production tubing annulus 12*a*. Additionally, the dual pipes 17*a*, 17*b* provide reduced leak risk by providing a redundant barrier to the flow in the bore 16*b* of the second pipe 17*b*.

During the life of a well 12, it may be necessary to perform additional intervention operations to improve the fluid flow from the well 12. Intervention operations may comprise any number of different operations. For example, intervention operations may comprise flow assurance management, pressure management, production annulus management, pressure testing, chemical sweeping, circulation and reverse circulation, bullheading, well kill, pigging, fluid sampling, inspection, acoustic testing, metering, production flow management, well isolation, and/or hydrate remediation.

To perform the intervention operations, different utility modules may be connected to the well production hub 10. For example, the utility modules may comprise a pressure/temperature sensor module, a sand erosion sensor module, a production choke module, a control pod module, a chemical injection module, an acoustics system module, and/or an LMRP as discussed above. It should be appreciated that the particular utility module may also be designed to incorporate one or more utilities into one module. There may also be more than one module connected to the well hub 10 at one time. In this manner, each well 12 may be isolated and intervention operations performed for that well 12 while any other wells 12 continue to produce production fluids. In addition, multiple wells 12 may be isolated together to allow fluid flow from one well 12 to another well 12.

The well production hub 10 may comprise a flowline connector 42 connecting the flowline 40 to the flowline header module 20 as illustrated in FIG. 2. Additionally, the flowline connector 42 may allow for the connection of a tool for flowline access and remediation/serviceability. Access to the flowline header module 20 allows for coiled tubing injection into the well production hub 10 as well as the flowline 40 for other potential intervention operations. As non-limiting examples, other potential intervention operations may comprise well jumper/flowline hydrate remediation, chemical squeeze operations, bullheading, circulation and displacement of well jumpers and/or a tiebacks, wellbore tubing and production casing annulus management due to thermal expansion or cool down, pig displacement operations, intelligent pigging, internal pipeline survey/inspections, dewatering, commissioning, pipeline wall inspection, and thermal insulation inspection surveys.

In a second embodiment as illustrated in FIG. 6, the production header module 18 may further comprise at least one well jumper termination coupling 34 for establishing fluid flow with a well 12 through the dual bore well jumper 16. The dual bore well jumper 16 comprises a first pipe 17*a* comprising a first pipe bore 16*a*. The dual bore well jumper 16 also comprises a second pipe 17*b* comprising a second pipe bore 16*b*, the second pipe being located outside of the first pipe bore 16*a*. Single bore well jumpers allow fluid flow in one direction at a time. As illustrated in FIG. 6, however, the dual bore well jumper 16 allows fluid flow through the well jumper 16 in different directions at the same time with the fluid flow in one direction being isolated from the fluid flow in the other direction, as indicated by the direction arrows "A" and "B". The dual bore well jumper 16 also allows the flow of different fluids in the same direction, the fluid in one bore 16*a* being isolated from the fluid flow in the second bore 16*b*.

Figure 7:
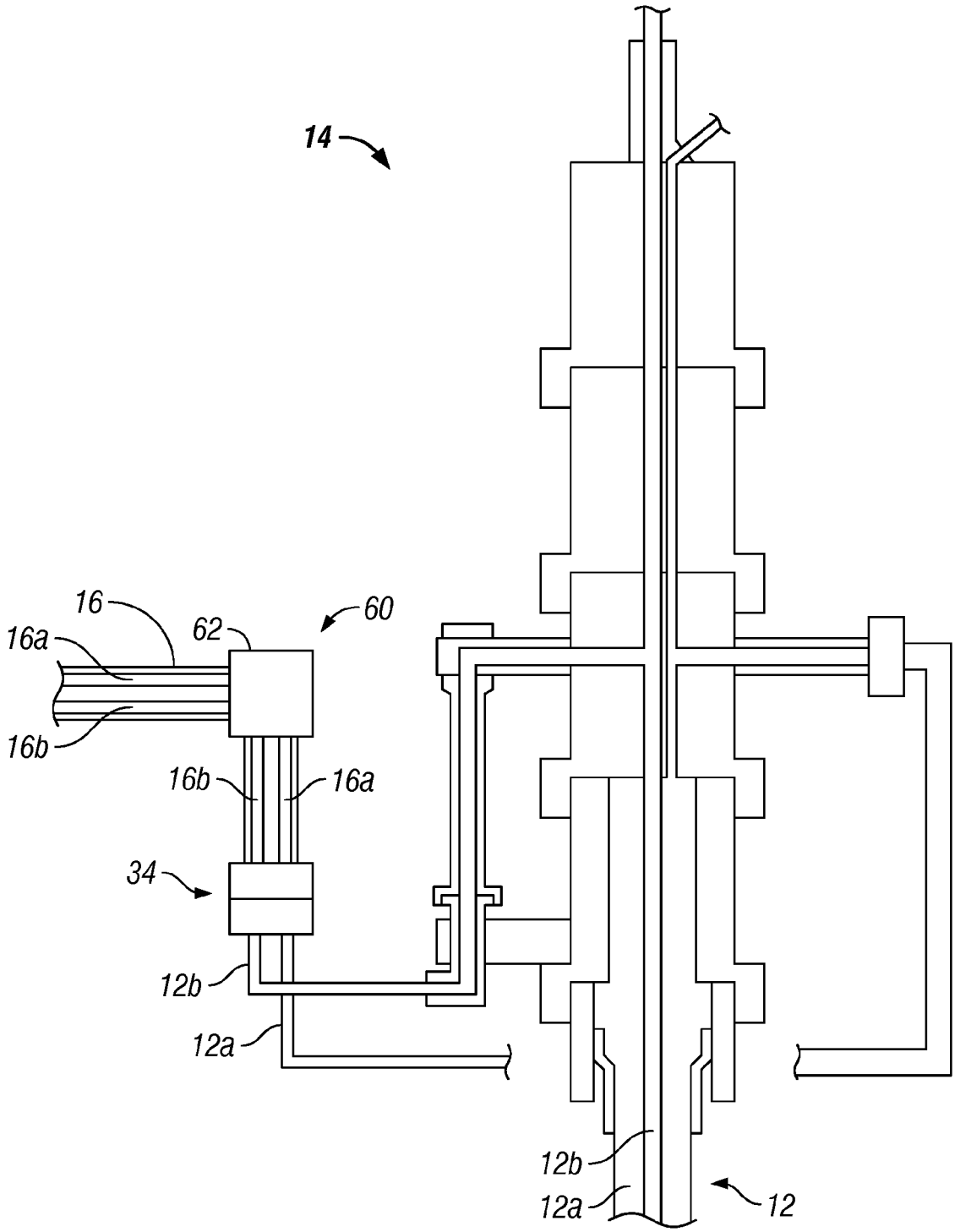
FIG. 7 is a schematic side elevation view of the dual bore well jumper of FIG. 6 connected a well tree.
Figure 9B:
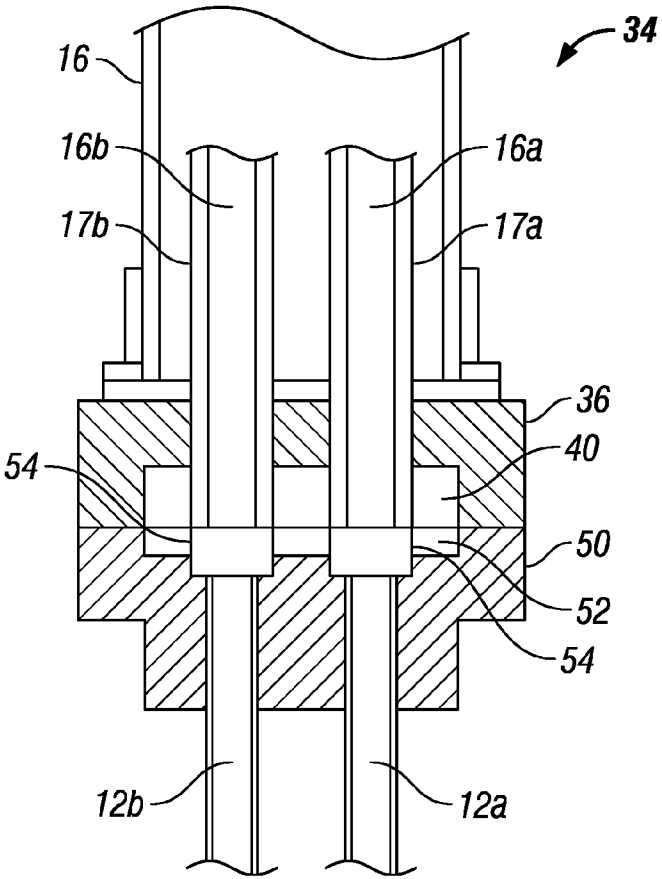
FIG. 9B is a schematic side elevation view of the connected end termination assembly of the dual bore well jumper of FIG. 6.
Figure 9A:
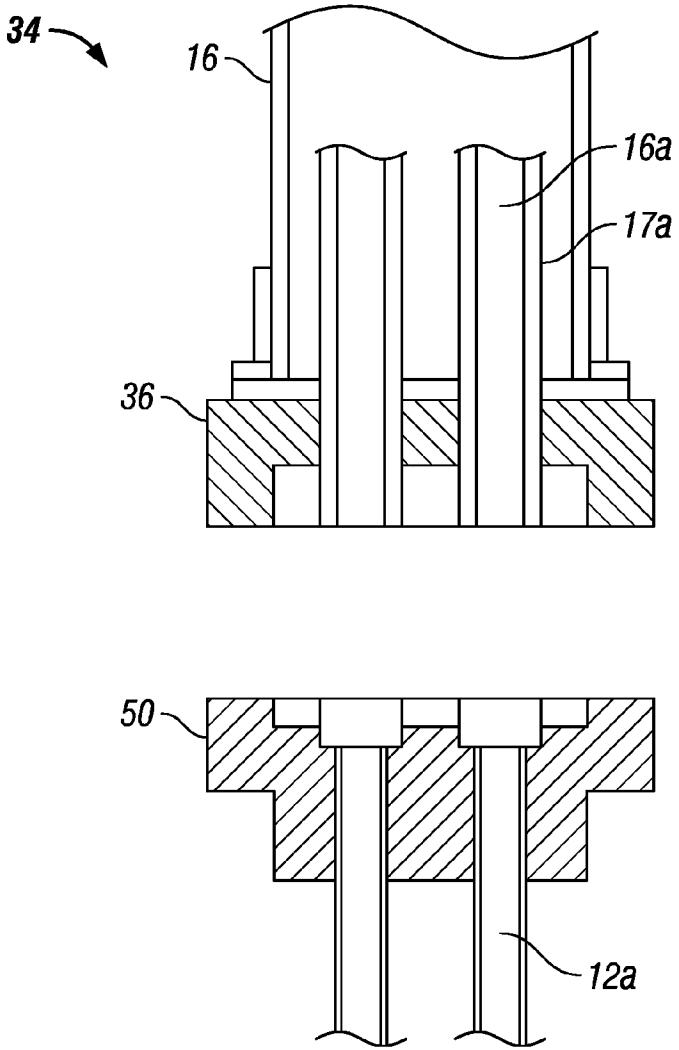
FIG. 9A is a schematic side elevation view of the unconnected end termination assembly of the dual bore well jumper of FIG. 6.

The dual bore jumper 16 illustrated in FIG. 6 comprises termination couplings 34 at each end coupling the jumper 16 with the well 12 or, as illustrated by the drawings, the well production hub 10. The termination couplings 34 may be any suitable type of coupling to provide sealed engagement. For example, as illustrated in FIGS. 9A and 9B, the dual bore well jumper 16 may comprise a stab-type termination coupling 34. The termination coupling 34 comprises a male base plate 36 sealingly engaged with the dual bore jumper 16. The first and second pipes 17*a*, 17*b* extend through and past the base plate 36. The item being connected to, whether it be a well tree or a production hub, comprises a corresponding female base plate 50 that sealingly engages with the male base plate 36 to form a combined annular area that includes the male base plate annular area 40 and the female base plate annular area 52. Upon connection, the first and second pipes 17*a*, 17*b* stab connect with bore connectors 54 that allow the flow in the first and second pipe bores 16*a*, 16*b* to communicate with first and second pipe flow conduits 12*a*, 12*b*, which, for example, may be the production tubing and annulus as illustrated in FIG. 7. Thus, the termination coupling 34 allows the dual bore jumper 16 to attach the well 12 or, as illustrated by the drawings, the well production hub 10. The termination coupling 34 may be used to attach to a coupler on any corresponding unit however, and is not limited to well trees or well production hubs.

Figure 8:
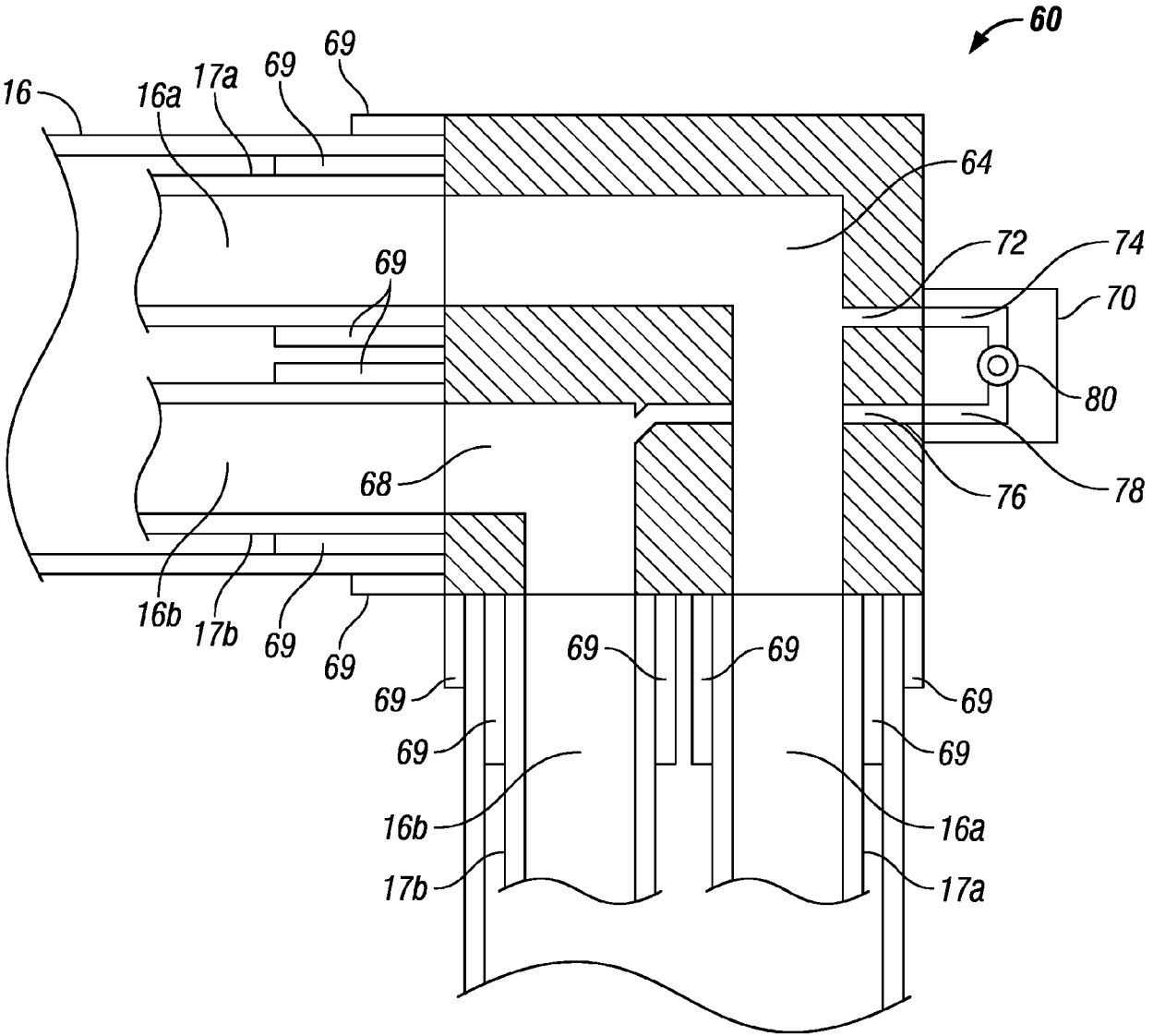
FIG. 8 is a schematic side elevation view of a junction assembly of the dual bore well jumper of FIG. 6.

As illustrated in FIG. 8, the dual bore well jumper 16 may optionally further comprise a junction assembly 60 fluidly connecting more than one set of said first and second pipes 17*a*, 17*b*. The junction assembly 60 comprises a junction assembly block 62. The sets of first and second pipes 17*a*, 17*b* attach to the junction assembly block 62 using a pipe adapter assembly that comprises pipe adapters 69. The engagement of the first and second pipes 17*a*, 17*b* with the pipe adapters 69 is adjustable such that the position of the well jumper 16 relative to the junction assembly 60 may be adjusted without losing the sealing connection. For example, the first and second pipes 17*a*, 17*b* may thread into the pipe adapters 69 such that relative movement is allowed without losing a sealed connection.

Within the junction assembly block 62 is at least one first junction bore 64 configured to allow fluid communication between the first pipe bores 16*a* attached to the junction assembly block 62. Also within the junction assembly block 62 is a second junction bore 69 configured to allow fluid communication between the second pipe bores 16*b*. The first junction bore 64 is configured to isolate fluid flow from the second junction bore 64 as fluid flows though the junction assembly 60. The junction assembly 60 may be configured such as to allow any suitable angle between the flow axis of the sets of first and second pipes 17*a*, 17*b*. For example, as illustrated in FIG. 8, the sets of first and second pipes 17*a*, 17*b* are at approximately 90 degrees to each other. Other angles may also be maintained, including no changed in direction at all if the junction assembly 60 is merely placed in-line with a well jumper 16. It should be appreciated that more than one set of first and second pipes 17*a*, 17*b* may also be attached to a junction assembly 60.

The junction assembly 60 may further optionally comprise a bore access module 70 attached to the junction assembly block 62. The bore access module 70 may attach to the junction assembly by any suitable connection, for example, a standard API flange connection. When attached to the junction assembly block 62, the bore access module 70 may be placed in selective fluid communication with the first and second junction bores 64 and 68. The bore access module 70 communicates with the first junction bore 64 through a first access bore 72 located in the junction assembly block 62 and a first module bore 74 located in the bore access module 70. The bore access module 70 communicates with the second junction bore 68 through a second access bore 76 located in the junction assembly block 62 and a second module bore 78 located in the bore access module 70. The bore access module 70 may perform any multitude of functions. For example the bore access module 70 may comprise a valve located in a utility bore 80 configured to allow fluid communication between the first junction bore 64 and the second junction bore 68. In this manner, the normally isolated fluids in the first and second pipe bores 16*a,b* may be commingled if desired. Alternatively, the bore access module may comprise a sensor located in the utility bore 80 for determining a characteristic of a fluid, the sensor being in selective fluid communication with the first and second junction bores 64 and 68. Also alternatively, the bore access module 60 may allow fluid injection into one or both of the first and second junction bores 64 and 68 through the utility bore 80.

The first and second pipe bores 16*a*, 16*b* provide independent pressure and fluid conduits to each other. With at least one well 12 connected to the well production hub 10, the initial stages of production may be performed, such as clean up, flow back, well testing, or other pre-production operations. The production header module 18 further comprises a utility interface 44 to which a utility module may be connected. The utility module may be any suitable utility module. For example, the utility module may be a lower marine rise package ("LMRP") that extends to the MODU or other vessel. With the LMRP connected to the well production hub 10, fluid flow through the dual bore jumper 16 may flow through the well production hub 10 and into the LMRP. The fluids initially produced by a well 12 may then be collected and tested to perform well clean up and well testing operations. Once a well 12 has been tested, flow from the dual bore well jumper 16 may then be directed into the flowline header module 20 and out through the flowline 40 to the host facility 41. The well production hub 10 may also be configured and set to isolate and test one well 12 at a time if more than one well 12 is connected to the well production hub 10. The well clean up and test fluids may also be directed to a host facility 41 through the flowline 40 instead of through the LMRP.

The dual bore well jumper 16 thus allows intervention procedures to be performed by allowing access to the production tubing in the well 12 as well as the production tubing annulus simultaneously. Thus, fluids may be circulated from a well production hub 10 and into the production tubing 12*b* through the second pipe bore 16*b* as illustrated by the connection in FIG. 3. From the production tubing, the fluids may circulate back up the production tubing annulus 12*a* and back to the well production hub 10 though the first pipe bore 16*a*. Additionally, fluids from the production tubing 12*b* may flow through the second pipe bore 16*b* to the well production hub 10 at the same time as fluid from the production tubing annulus 12*a* flows through the first pipe bore 16*a* to the well production hub 10. This allows for simultaneous annulus pressure management while production fluids are still being produced from the well 12. Another example is if a packer sealing the production tubing annulus 12*a* begins to leak, a gas cap may be injected through the first pipe bore 16*a* to control the pressure in the production tubing annulus 12*a*. Additionally, the dual pipes 17*a*, 17*b* may be encased in an outer conduit 19 to provide reduced leak risk by providing a redundant barrier to the flow in the first and second bores 16*a*, 16*b* of the first and second pipes 17*a*, 17*b*. The dual bore well jumper 16 may optionally have the outer conduit 19 rigid enough to allow single point contact with rigging without catastrophic bending of the dual bore well jumper 16.

During the life of a well 12, it may be necessary to perform additional intervention operations to improve the fluid flow from the well 12. Intervention operations may comprise any number of different operations. For example, intervention operations may comprise flow assurance management, pressure management, production annulus management, pressure testing, chemical sweeping, circulation and reverse circulation, bullheading, well kill, pigging, fluid sampling, inspection, acoustic testing, metering, production flow management, well isolation, and/or hydrate remediation.

To perform the intervention operations, different utility modules may be connected to the well production hub 10. For example, the utility modules may comprise a pressure/temperature sensor module, a sand erosion sensor module, a production choke module, a control pod module, a chemical injection module, an acoustics system module, and/or an LMRP as discussed above. It should be appreciated that the particular utility module may also be designed to incorporate one or more utilities into one module. There may also be more than one module connected to the well hub 10 at one time. In this manner, each well 12 may be isolated and intervention operations performed for that well 12 while any other wells 12 continue to produce production fluids. In addition, multiple wells 12 may be isolated together to allow fluid flow from one well 12 to another well 12.

The well production hub 10 may comprise a flowline connector 42 connecting the flowline 40 to the flowline header module 20 as illustrated in FIG. 2. Additionally, the flowline connector 42 may allow for the connection of a tool for flowline access and remediation/serviceability. Access to the flowline header module 20 allows for coiled tubing injection into the well production hub 10 as well as the flowline 40 for other potential intervention operations. As non-limiting examples, other potential intervention operations may comprise well jumper/flowline hydrate remediation, chemical squeeze operations, bullheading, circulation and displacement of well jumpers and/or a tiebacks, wellbore tubing and production casing annulus management due to thermal expansion or cool down, pig displacement operations, intelligent pigging, internal pipeline survey/inspections, dewatering, commissioning, pipeline wall inspection, and thermal insulation inspection surveys.

While specific embodiments have been shown and described, modifications can be made by one skilled in the art without departing from the spirit or teaching of this invention. The embodiments as described are exemplary only and are not limiting. Many variations and modifications are possible and are within the scope of the invention. Accordingly, the scope of protection is not limited to the embodiments described, but is only limited by the claims that follow, the scope of which shall include all equivalents of the subject matter of the claims.

What is claimed is:

1. A well jumper for establishing fluid communication between a subsea well comprising first and second well flowbores and a subsea flowline, comprising:

a first pipe comprising a first pipe bore;

a second pipe comprising a second pipe bore, said second pipe being located within said first pipe bore;

a first termination coupling for establishing fluid communication between said first pipe bore and the first well flowbore and between said second pipe bore and the second well flowbore;

a second termination coupling for establishing fluid communication between said first and second pipe bores and the flowline; and said first and second pipe bores being configured to isolate fluid flow in said first pipe bore from fluid flow in said second pipe bore;

a junction assembly fluidly connecting more than one set of said first and second pipes;

said junction assembly comprising a first junction bore configured to allow fluid communication between said first pipe bores;

said junction assembly comprising a second junction bore configured to allow fluid communication between said second pipe bores;

said first and second junction bores being configured to isolate fluid flow in said first junction bore from fluid flow in said second junction bore;

said junction assembly further comprising a first access bore allowing fluid communication with said first junction bore and a second access bore allowing fluid communication with said second junction bore;

a bore access module attached to said junction assembly comprising a first module bore allowing fluid communication with said first access bore and a second module bore allowing fluid communication with said second access bore; and said bore access module being in selective fluid communication with said first and second junction bores.

2. The well jumper of claim 1 wherein said bore access module further comprises a valve configured to allow fluid communication between said first junction bore and said second junction bore.

3. The well jumper of claim 1 wherein said bore access module further comprises a sensor for determining a characteristic of a fluid, said sensor being in selective fluid communication with said first and second junction bores.

4. The well jumper of claim 1 wherein said bore access module further allows fluid injection into said first junction bore and/or said second junction bore.

5. A well jumper for establishing fluid communication between a subsea well comprising first and second well flowbores and a subsea flowline, comprising:

a first comprising a first bore;

a second comprising a second bore, said second being located within said first bore;

a first termination coupling for establishing fluid communication between said first pipe bore and the first well flowbore and between said second pipe bore and the second well flowbore;

a second termination coupling for establishing fluid communication between said first and second pipe bores and the flowline; said first and second pipe bores being configured to isolate fluid flow in said first pipe bore from fluid flow in said second bore;

wherein said well jumper is configured to communicate with the well flowbores though a well tree connected to a wellhead.

6. A well jumper for establishing fluid communication between a subsea well comprising first and second well flowbores and a subsea flowline, comprising:

a first comprising a first bore;

a second comprising a second bore, said second being located within said first bore;

a first termination coupling for establishing fluid communication between said first bore and the first well flowbore and between said second pipe bore and the second well flowbore;

a second termination coupling for establishing fluid communication between said first and second bores and the flowline;

said first and second bores being configured to isolate fluid flow in said first pipe bore from fluid flow in said second bore;

wherein said well jumper is configured to communicate with the flowline though a production manifold.

7. A method of fluidly communicating between a subsea well comprising first and second well flowbores and a subsea flowline comprising:

flowing fluid between the subsea well and the flowline through a first pipe comprising a first bore;

flowing fluid between the subsea well and the flowline through a second pipe comprising a second bore, said second pipe being located within said first pipe bore;

isolating fluid flow in said first pipe bore from fluid flow in said second pipe bore;

wherein flowing fluid through said first and second pipe bores further comprises:

flowing fluid through a junction assembly fluidly connecting more than one set of said first and seconds pipes;

wherein flowing fluid between one first pipe bore and another first pipe bore through said junction assembly comprises flowing fluid through a first junction bore configured to allow fluid communication between said first pipe bores;

wherein flowing fluid between one second pipe bore and another second pipe bore through said junction assembly comprises flowing fluid through a second junction bore configured to allow fluid communication between said second pipe bores; and isolating fluid flow in said first junction bore from fluid flow in said second junction bore;

attaching a bore access module to said junction assembly;

flowing fluid between said first junction bore and said bore access module through a first access bore in said junction assembly and a first module bore in said bore access module;

flowing fluid between said second junction bore and said bore access module through a second access bore in said junction assembly and a second module bore in said bore access module; and selectively flowing fluid between said first junction bore and said second junction bore through said bore access module using a valve.

8. A method of fluidly communicating between a subsea well comprising first and second well flowbores and a subsea flowline comprising:

flowing fluid between the subsea well and the flowline through a first pipe comprising a first pipe bore;

flowing fluid between the subsea well and the flowline through a second pipe comprising a second pipe bore, said second pipe being located within said first pipe bore;

isolating fluid flow in said first pipe bore from fluid flow in said second pipe bore;

wherein flowing fluid through said first and second pipe bores further comprises:

flowing fluid through a junction assembly fluidly connecting more than one set of said first and second pipes;

wherein flowing fluid between one first pipe bore and another first pipe bore through said junction assembly comprises flowing fluid through a first junction bore configured to allow fluid communication between said first pipe bores;

wherein flowing fluid between one second pipe bore and another second pipe bore through said junction assembly comprises flowing fluid through a second junction bore configured to allow fluid communication between said second pipe bores; and isolating fluid flow in said first junction bore from fluid flow in said second junction bore;

attaching a bore access module to said junction assembly;

flowing fluid between said first junction bore and said bore access module through a first access bore in said junction assembly and a first module bore in said bore access module;

flowing fluid between said second junction bore and said bore access module through a second access bore in said junction assembly and a second module bore in said bore access module; and determining at least one characteristic of a fluid flowing through said bore access module using a sensor.

9. A method of fluidly communicating between a subsea well comprising first and second well flowbores and a subsea flowline comprising:

flowing fluid between the subsea well and the flowline through a first pipe comprising a first pipe bore;

flowing fluid between the subsea well and the flowline through a second pipe comprising a second pipe bore, said second pipe being located within said first pipe bore;

isolating fluid flow in said first pipe bore from fluid flow in said second pipe bore;

wherein flowing fluid through said first and second pipe bores further comprises:

flowing fluid through a junction assembly fluidly connecting more than one set of said first and second pipes;

wherein flowing fluid between one first pipe bore and another first pipe bore through said junction assembly comprises flowing fluid through a first junction bore configured to allow fluid communication between said first pipe bores;

wherein flowing fluid between one second pipe bore and another second pipe bore through said junction assembly comprises flowing fluid through a second junction bore configured to allow fluid communication between said second pipe bores; and isolating fluid flow in said first junction bore from fluid flow in said second junction bore;

attaching a bore access module to said junction assembly;

flowing fluid between said first junction bore and said bore access module through a first access bore in said junction assembly and a first module bore in said bore access module;

flowing fluid between said second junction bore and said bore access module through a second access bore in said junction assembly and a second module bore in said bore access module; and injecting fluid into said junction assembly from said bore access module.

10. A method of fluidly communicating between a subsea well comprising first and second well flowbores and a subsea flowline comprising:

flowing fluid between the subsea well and the flowline through a first pipe comprising a first pipe bore;

flowing fluid between the subsea well and the flowline through a second pipe comprising a second pipe bore, said second pipe being located within said first pipe bore;

isolating fluid flow in said first pipe bore from fluid flow in said second pipe bore; and fluidly communicating with the well flowbores through a well tree connected to a wellhead.

11. A method of fluidly communicating between a subsea well comprising first and second well flowbores and a subsea flowline comprising:

flowing fluid between the subsea well and the flowline through a first pipe comprising a first pipe bore;

flowing fluid between the subsea well and the flowline through a second pipe comprising a second pipe bore, said second pipe being located within said first pipe bore;

isolating fluid flow in said first pipe bore from fluid flow in said second pipe bore; and fluidly communicating with the flowline through a flowline connector supported on an in-line pipe line end termination unit.

12. A method of fluidly communicating between a subsea well comprising first and second well flowbores and a subsea flowline comprising:

flowing fluid between the subsea well and the flowline through a first pipe comprising a first pipe bore;

flowing fluid between the subsea well and the flowline through a second pipe comprising a second pipe bore, said second pipe being located within said first pipe bore;

isolating fluid flow in said first pipe bore from fluid flow in said second pipe bore; and fluidly communicating with the flowline though a production manifold.

13. A well jumper for establishing fluid communication between a subsea well comprising first and second well flowbores and a subsea flowline, comprising:

a first pipe comprising a first pipe bore;

a second pipe comprising a second pipe bore, said second pipe being located outside of said first pipe;

a first termination coupling for establishing fluid communication between said first pipe bore and the first well flowbore and between said second pipe bore and the second well flowbore;

a second termination coupling for establishing fluid communication between said first and second pipe bores and the flowline; and said first and second pipe bores being configured to isolate fluid flow in said first pipe bore from fluid flow in said second pipe bore;

a junction assembly fluidly connecting more than one set of said first and second pipes;

said junction assembly comprising a first junction bore configured to allow fluid communication between said first pipe bores;

said junction assembly comprising a second junction bore configured to allow fluid communication between said second pipe bores;

said first and second junction bores being configured to isolate fluid flow in said first junction bore from fluid flow in said second junction bore;

said junction assembly further comprising a first access bore allowing fluid communication with said first junction bore and a second access bore allowing fluid communication with said second junction bore;

a bore access module attached to said junction assembly comprising a first module bore allowing fluid communication with said first access bore and a second module bore allowing fluid communication with said second access bore; and said bore access module being in selective fluid communication with said first and second junction bores.

14. The well jumper of claim 13 wherein said bore access module further comprises a valve configured to allow fluid communication between said first junction bore and said second junction bore.

15. The well jumper of claim 13 wherein said bore access module further comprises a sensor for determining a characteristic of a fluid, said sensor being in selective fluid communication with said first and second junction bores.

16. The well jumper of claim 13 wherein said bore access module further allows fluid injection into said first junction bore and/or said second junction bore.

17. A well jumper for establishing fluid communication between a subsea well comprising first and second well flowbores and a subsea flowline, comprising:

a first pipe comprising a first pipe bore;

a second pipe comprising a second pipe bore, said second pipe being located outside of said first pipe;

a first termination coupling for establishing fluid communication between said first pipe bore and the first well flowbore and between said second pipe bore and the second well flowbore;

a second termination coupling for establishing fluid communication between said first and second pipe bores and the flowline; and said first and second pipe bores being configured to isolate fluid flow in said first pipe bore from fluid flow in said second pipe bore;

a junction assembly fluidly connecting more than one set of said first and second pipes;

said junction assembly comprising a first junction bore configured to allow fluid communication between said first pipe bores;

said junction assembly comprising a second junction bore configured to allow fluid communication between said second pipe bores;

said first and second junction bores being configured to isolate fluid flow in said first junction bore from fluid flow in said second junction bore;

wherein said first and second pipes are configured to allow fluid to flow into the second well flowbore through said second pipe bore, out of the well through the first well flowbore, and then through said first pipe bore.

18. A well jumper for establishing fluid communication between a subsea well comprising first and second well flowbores and a subsea flowline, comprising:

a first pipe comprising a first pipe bore;

a second pipe comprising a second pipe bore, said second pipe being located outside of said first pipe;

a first termination coupling for establishing fluid communication between said first pipe bore and the first well flowbore and between said second pipe bore and the second well flowbore;

a second termination coupling for establishing fluid communication between said first and second pipe bores and the flowline; and said first and second pipe bores being configured to isolate fluid flow in said first pipe bore from fluid flow in said second pipe bore;

wherein said well jumper is configured to communicate with the well flowbores though a well tree connected to a wellhead.

19. A well jumper for establishing fluid communication between a subsea well comprising first and second well flowbores and a subsea flowline, comprising:

a first pipe comprising a first pipe bore;

a second pipe comprising a second pipe bore, said second pipe being located outside of said first pipe;

a first termination coupling for establishing fluid communication between said first pipe bore and the first well flowbore and between said second pipe bore and the second well flowbore;

a second termination coupling for establishing fluid communication between said first and second pipe bores and the flowline; and said first and second pipe bores being configured to isolate fluid flow in said first pipe bore from fluid flow in said second pipe bore;

wherein said well jumper is configured to communicate with the flowline through a flowline connector supported on an in-line pipe line end termination unit.

20. A well jumper for establishing fluid communication between a subsea well comprising first and second well flowbores and a subsea flowline, comprising:

a first pipe comprising a first pipe bore;

a second pipe comprising a second pipe bore, said second pipe being located outside of said first pipe;

a first termination coupling for establishing fluid communication between said first pipe bore and the first well flowbore and between said second pipe bore and the second well flowbore;

a second termination coupling for establishing fluid communication between said first and second pipe bores and the flowline; and said first and second pipe bores being configured to isolate fluid flow in said first pipe bore from fluid flow in said second pipe bore;

wherein said well jumper is configured to communicate with the flowline though a production manifold.

21. A method of fluidly communicating between a subsea well comprising first and second well flowbores and a subsea flowline comprising:

flowing fluid between the subsea well and the flowline through a first pipe comprising a first pipe bore;

flowing fluid between the subsea well and the flowline through a second pipe comprising a second pipe bore, said second pipe being located outside of said first pipe; and isolating fluid flow in said first pipe bore from fluid flow in said second pipe bore;

wherein flowing fluid through said first and second pipe bores further comprises:

flowing fluid through a junction assembly fluidly connecting more than one set of said first and second pipes;

wherein flowing fluid between one first pipe bore and another first pipe bore through said junction assembly comprises flowing fluid through a first junction bore configured to allow fluid communication between said first pipe bores;

wherein flowing fluid between one second pipe bore and another second pipe bore through said junction assembly comprises flowing fluid through a second junction bore configured to allow fluid communication between said second pipe bores; and isolating fluid flow in said first junction bore from fluid flow in said second junction bore;

attaching a bore access module to said junction assembly;

flowing fluid between said first junction bore and said bore access module through a first access bore in said junction assembly and a first module bore in said bore access module;

flowing fluid between said second junction bore and said bore access module through a second access bore in said junction assembly and a second module bore in said bore access module; and selectively flowing fluid between said first junction bore and said second junction bore through said bore access module using a valve.

22. A method of fluidly communicating between a subsea well comprising first and second well flowbores and a subsea flowline comprising:

flowing fluid between the subsea well and the flowline through a first pipe comprising a first pipe bore;

flowing fluid between the subsea well and the flowline through a second pipe comprising a second pipe bore, said second pipe being located outside of said first pipe; and isolating fluid flow in said first pipe bore from fluid flow in said second pipe bore;

wherein flowing fluid through said first and second pipe bores further comprises:

flowing fluid through a junction assembly fluidly connecting more than one set of said first and second pipes;

wherein flowing fluid between one first pipe bore and another first pipe bore through said junction assembly comprises flowing fluid through a first junction bore configured to allow fluid communication between said first pipe bores;

wherein flowing fluid between one second pipe bore and another second pipe bore through said junction assembly comprises flowing fluid through a second junction bore configured to allow fluid communication between said second pipe bores; and isolating fluid flow in said first junction bore from fluid flow in said second junction bore;

attaching a bore access module to said junction assembly;

flowing fluid between said first junction bore and said bore access module through a first access bore in said junction assembly and a first module bore in said bore access module;

flowing fluid between said second junction bore and said bore access module through a second access bore in said junction assembly and a second module bore in said bore access module; and determining at least one characteristic of a fluid flowing through said bore access module using a sensor.

23. A method of fluidly communicating between a subsea well comprising first and second well flowbores and a subsea flowline comprising:

flowing fluid between the subsea well and the flowline through a first pipe comprising a first pipe bore;

flowing fluid between the subsea well and the flowline through a second pipe comprising a second pipe bore, said second pipe being located outside of said first pipe; and isolating fluid flow in said first pipe bore from fluid flow in said second pipe bore;

wherein flowing fluid through said first and second pipe bores further comprises:

flowing fluid through a junction assembly fluidly connecting more than one set of said first and second pipes;

wherein flowing fluid between one first pipe bore and another first pipe bore through said junction assembly comprises flowing fluid through a first junction bore configured to allow fluid communication between said first pipe bores;

wherein flowing fluid between one second pipe bore and another second pipe bore through said junction assembly comprises flowing fluid through a second junction bore configured to allow fluid communication between said second pipe bores; and isolating fluid flow in said first junction bore from fluid flow in said second junction bore;

attaching a bore access module to said junction assembly;

flowing fluid between said first junction bore and said bore access module through a first access bore in said junction assembly and a first module bore in said bore access module;

flowing fluid between said second junction bore and said bore access module through a second access bore in said junction assembly and a second module bore in said bore access module; and injecting fluid into said junction assembly from said bore access module.

24. A method of fluidly communicating between a subsea well comprising first and second well flowbores and a subsea flowline comprising:

flowing fluid between the subsea well and the flowline through a first pipe comprising a first pipe bore;

flowing fluid between the subsea well and the flowline through a second pipe comprising a second pipe bore, said second pipe being located outside of said first pipe;

isolating fluid flow in said first pipe bore from fluid flow in said second pipe bore; and fluidly communicating with the well flowbores through a well tree connected to a wellhead.

25. A method of fluidly communicating between a subsea well comprising first and second well flowbores and a subsea flowline comprising:

flowing fluid between the subsea well and the flowline through a first pipe comprising a first pipe bore;

flowing fluid between the subsea well and the flowline through a second pipe comprising a second pipe bore, said second pipe being located outside of said first pipe;

isolating fluid flow in said first pipe bore from fluid flow in said second pipe bore; and further comprising fluidly communicating with the flowline though a production manifold.

* * * * *

UNITED STATES PATENT AND TRADEMARK OFFICE

CERTIFICATE OF CORRECTION

PATENT NO. : 7,565,931 B2
APPLICATION NO. : 11/284976
DATED : July 28, 2009
INVENTOR(S) : Brian J. Saucier It is certified that error appears in the above-identified patent and that said Letters Patent is hereby corrected as shown below:

In Claim 6, Column 10, Line 50, the word --pipe-- should be inserted to read "a first pipe comprising a first bore;"

In Claim 6, Column 10, Line 51, the word --pipe-- should be inserted to read "a second pipe comprising a second bore,"

Signed and Sealed this

Eighth Day of September, 2009

David J. Kappos

David J. Kappos
*Director of the United States Patent and Trademark Office*